United States Patent [19]

Lotz

[11] 3,943,684

[45] Mar. 16, 1976

[54] TIME DELAY FOR INTERLEAVING MACHINE

[76] Inventor: Walter E. Lotz, 74 Laureleaf Road, Thornhill, Ontario, Canada

[22] Filed: Mar. 31, 1975

[21] Appl. No.: 563,484

[52] U.S. Cl. ..... 53/66; 53/389

[51] Int. Cl.² ..... B65B 57/02

[58] Field of Search ..... 53/66, 389

[56] References Cited

UNITED STATES PATENTS

| | | | |
|---|---|---|---|
| 3,250,054 | 5/1966 | Hurlbut et al. | 53/66 |
| 3,486,293 | 12/1969 | VandeBilt | 53/66 |
| 3,513,625 | 5/1970 | Eller et al. | 53/66 |

*Primary Examiner*—Travis S. McGehee

[57] ABSTRACT

Apparatus for feeding separate pieces of sheet material from a continuous supply thereof to individual articles travelling along a predetermined path and positioning a piece of sheet material under each article. The articles are conveyed sequentially along the predetermined path, and the sheet material is fed from a continuous supply thereof to a cutting station. At the cutting station, pieces of sheet material are cut from the continuous supply, and the pieces of sheet material are fed from the cutting station to an article conveyor for entrainment between the underside of an article and the conveyor at a material positioning station. The articles are sensed as they travel along the predetermined path to the material positioning station. Feeding and cutting control mechanisms are actuated by the article senser to cause the feed of sheet material to the cutting station to be commenced when the senser senses an article passing thereby, and to be stopped when the senser senses that the article has passed. The control mechanisms include a delay to cause operation of the cutter to cut a piece of sheet material from the continuous supply a predetermined time after the senser actuates the control mechanisms to stop the feed of material. The predetermined time is sufficient to ensure that feed of sheet material has actually stopped before the cutter operates.

8 Claims, 3 Drawing Figures

TIME DELAY FOR INTERLEAVING MACHINE

This invention relates to interleaving machines, which feed separate pieces of sheet material from a continuous supply thereof to individual articles travelling along a predetermined path, so as to position a piece of sheet material under each article.

Such machines are used, for example, to position the pieces of sheet material under pieces of meat, commonly known as "patties", so that when the patties are stacked one upon the other, a piece of sheet material is interleaved between each adjacent pair of patties in the stack. Pieces of sliced meat may also be interleaved with sheet material by these machines.

It is necessary that the length of the interleaving sheet be selected in relation to the length of the article concerned. It is therefore necessary that an interleaving machine be capable of operation with articles of various lengths, and interleaving machines are known which automatically provide an interleaving sheet with a suitable length corresponding to the length of the article below which the sheet is to be positioned. The length of the article is sensed as it travels along the predetermined path, and a sheet of the appropriate length is automatically cut from the continuous supply of material and fed to the appropriate location for positioning beneath the article.

In practice, this means that the continuous supply of sheet material is started and stopped as the article is initially sensed by and then leaves the actual sensing means provided.

The starting and stopping of the continuous supply of sheet material as the article passes the sensing means creates a problem with the feed of the sheet material through the machine. In the known machine, the sensing of an article passing the sensing means causes the continuous supply of sheet material to be started, so as to feed a sheet towards the interleaving position. When the article has passed the sensing means, the continuous supply is stopped and the cutter is operated to cut the sheet from the continuous supply. The cut sheet then travels to the interleaving position.

It has been found that, in the known machine, the feed of sheet material continues for a short time after the cutting has been effected, so that a leading end of the sheet material, i.e. the leading end of the next sheet, projects beyond the cutter. During the time before the feed of sheet material is started by the sensing means on sensing the next article, the projecting end of sheet material sometimes becomes bent, for one reason or another, with the result that, when the feed of sheet material from the continuous supply is started again, the projecting end is out of alignment with the subsequent feed path to the interleaving position, with the result that the machine becomes jammed.

It is therefore an object of the invention to provide an improved interleaving machine of this kind in which the problem mentioned above is overcome.

According to the invention, the feeding and cutting of sheet material from the continuous supply is controlled by means actuated by article sensing means to cause the feed of sheet material to a cutting station to be commenced when the sensing means senses an article passing thereby and to be stopped when the sensing means senses that the article has passed thereby, and the control means includes means to cause operation of the cutting means to cut a piece of sheet material from the continuous supply a predetermined time after the sensing means actuates control means to stop the feed means, the predetermined time being sufficient to ensure that feed of sheet material has actually stopped before the cutting means operates.

Advantageously, the cutting means is electrically operated by an electrical actuating circuit, and the control means includes electrical delay means operable to cause said actuating circuit to operate said cutting means said predetermined time after said sensing means actuates said control means to stop said feed means. The control means may include an electrical time delay device actuated by said article sensing means to set said electrical actuating circuit when an article is sensed by said article sensing means, said article sensing means causing actuation of said time delay device when said article has passed by said article sensing means, and said time delay device operating to cause said electrical actuating circuit to operate said cutting means said predetermined time after the cessation of its actuation by said sensing means.

The time delay device may include a relay which controls normally closed contacts in said actuating circuit, said relay being actuated by said sensing means, when sensing an article passing thereby, to open said contacts, said sensing means ceasing to actuate said relay when an article has passed by said sensing means, and said time delay device including means for holding said relay in its actuated state for said predetermined time after actuation by said sensing means has ceased, after which said relay causes said contacts to close with resultant operation of said cutting means. The means for holding the relay closed may be a capacitor connected across said relay. The article sensing means may be connected in an AC circuit, with the relay and the capacitor being energized from the AC circuit through rectifier means so that the relay and capacitor are supplied with direct current.

The control means may also include a second electrical time delay device which operates to cause said electrical actuating circuit to cease operation of said cutting means a second predetermined time after said first delay device has caused said electrical actuating circuit to operate said cutting means. The second time delay device may include a second relay which controls normally open contacts in said actuating circuit, said second relay being actuated by said first relay, when said first relay is in its actuated state, to close said contacts, said second time delay device including means for holding said second relay in its actuated state, after actuation by said first relay has ceased for a second predetermined time after which said second relay causes said contacts to open with resultant cessation of actuation of said cutting means.

One embodiment of the present invention will now be described, by way of example, with reference to the accompanying drawing, of which;

Figure 2:
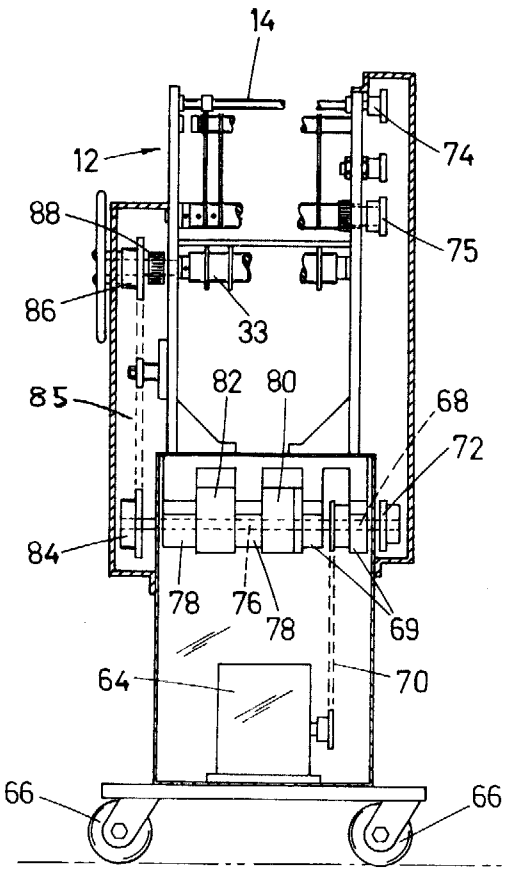
FIG. 2 is a diagramatic end view of the machine, showing various drive arrangements, other parts of the machine being omitted for clarity.
Figure 1:
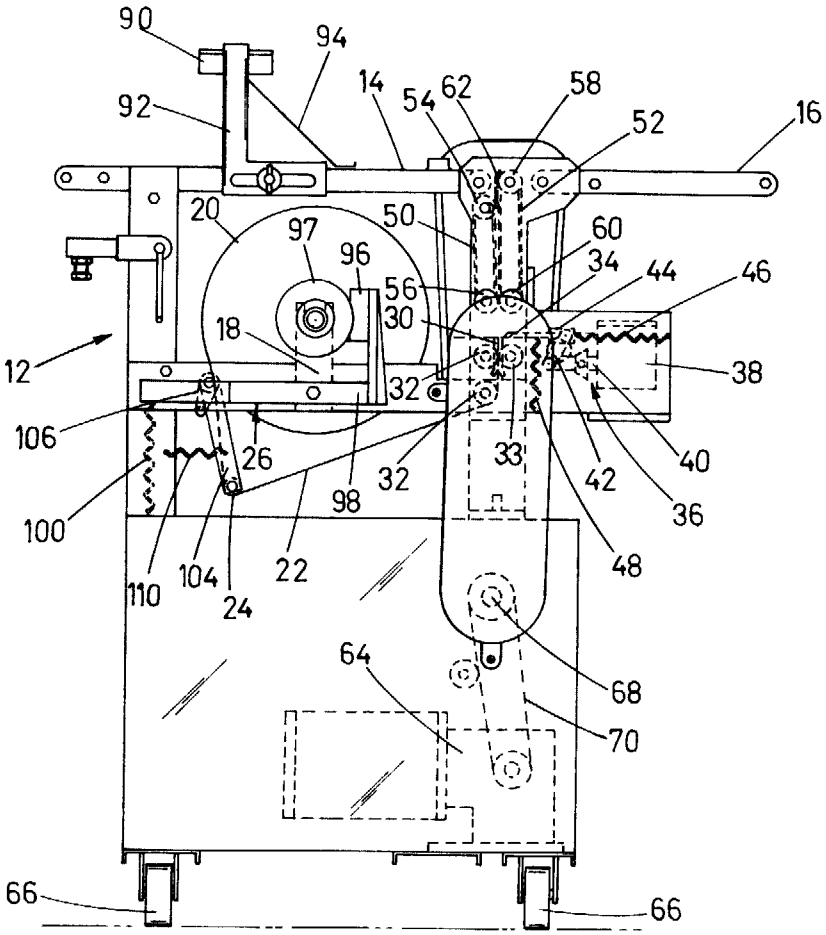
FIG. 1 is a diagramatic side view of an interleaving machine.

Referring to the drawings, FIGS. 1 and 2 show an interleaving machine which is similar in construction to the interleaving machine described in Canadian Pat.

No. 738,878 issued July 19, 1966 and U.S. Pat. No. 3,296,768 issued Jan. 10, 1967. These patents describe an example of the known machine referred to in the opening paragraphs of this application.

The machine has a frame 12 which carries a first horizontal endless belt conveyor 14 and a second horizontal endless belt conveyor 16 following but spaced from the first conveyor 14. The frame 12 has a support 18 for rotatably supporting a roll 20 of sheet material 22. From the roll 20, the sheet material 22 passes around an idler pulley 24 on a tension control 26, and around a further idler pulley 28 to a pair of vertical guides 32 between which the sheet material 22 passes.

A pair of feed rollers 32, 33 are rotatably mounted on opposite sides of the guides 30, and project through apertures in the guides 30 into driving engagement with the sheet 22 so that, when the feed rollers 32, 33 rotate, the sheet material 22 is drawn from the supply roll 20 and passes upwardly between the guides 30. As will be explained in more detail later, the feed rollers 32, 33 are intermittently rotated to provide the necessary supply of sheet material 22 to subsequent parts of the machine.

Immediately above the guides 30 is a cutter blade 34 forming part of an electrically-actuated cutter 36. The cutter 36 has a solenoid 38 from which a solenoid shaft 40 projects. The projecting end of solenoid shaft 40 is pivotally connected to one end of a short link 42, which is pivotally connected to the frame 12 at its central point. The other end of the link 42 is pivotally connected to a cutter blade holder 44 from which the cutter blade 34 projects. The cutter blade 34 is positioned to slide along the top of the guides 30. A first tension spring 46 connected between the blade holder 44 and the frame 12 urges the blade 34 to a withdrawn position, and a second tension spring 48 connected between the blade and the frame 12 resiliently holds the cutter blade 34 against the top of the guides 30 during cutting movement of the blade 34. As also will be described in more detail later, electrical actuation of the cutter solenoid causes withdrawal of of the solenoid shaft 40 into the solenoid housing 38, with resultant pivotal movement of link 42 and movement of the blade 34 across the top of the guides 30 to cut the sheet material 22 projecting upwardly therefrom.

Above the guides 30 is a pair of vertically oriented endless feed belts 50, 52. The endless belt 50 passes around a pair of vertically spaced pulleys 54, 56, and the endless belt 52 passes around a pair of vertically spaced pulleys 58, 60. The endless belts 50, 52 form adjacent upwardly travelling runs aligned with the guides 30, so that the sheet material fed upwardly through the guides 30 by the feed rollers 32, 33 passes between the belts 50, 52, and is fed upwardly thereby. The upper pulley 58 of the belt 52, and a guide 62 extends upwardly from the pulley 54 to the pulley 58, so that the sheet material 22 passing upwardly between the belts 50, 52 is positioned in the path of an article travelling along the first conveyor 14.

The machine is powered by an electric motor 64 carried by the base of the frame 12, which it will be seen is mounted on castors 66. The main shaft 68 rotatably mounted in bearings 69 carried by the frame 12 is rotated by the motor 64 by means of a drive chain 70. The main shaft 68 has a sprocket 72 at one end which is coupled by a further drive chain (not shown for purpose of clarity) to a sprocket 74 forming part of the first conveyor 14, a second conveyor 16 being operated simultaneously with the first conveyor 14 by a drive chain (not shown) connected therebetween. The drive chain from the main shaft sprocket 72 also passes around a sprocket 75 associated with the lower pulley 60 of the vertical endless belt 52, so that the belt 52 is also powered by the motor 64. Intermeshing gears couple the pulleys 56, 60 so that the belt 50 is driven at the same speed as belt 52.

Thus, when the motor 64 is running, the conveyors 14, 16 and the belts 50, 52 all run continuously at the same speed.

A secondary shaft 76 extends co-axially with the main shaft 68, and is mounted in bearings 78 carried by the frame 12. An electrically operated clutch 80 carried by the frame 12 has one part connected to the main shaft 68 and another part connected to the secondary shaft 76. When actuated, the clutch 80 causes the main shaft 68 to rotate the secondary shaft 76. The frame 12 also carries an electrically actuated brake 82 through which the secondary shaft 76 passes. When actuated, the brake 82 applies a braking force to the secondary shaft 76.

The secondary shaft 76 has a sprocket 84 at one end which is coupled by a drive chain 85 to a sprocket 86 connected to feed roller 33, the drive roller 33 being connected to feed roller 32 through intermeshing gears 88, so that feed rollers 32, 33 rotate simultaneously in opposite directions.

A microswitch 90 is mounted over the first conveyor 14 by a support 92 which is adjustably secured to the frame 12. The microswitch 90 has an actuating finger 94 extending from the switch 90 to a position close to the conveyor 14, so that the finger 94 is deflected by an article travelling along conveyor 14 to cause microswitch 90 to be closed.

It will now be convenient to describe the construction and operation of the tension control 26. A brake 96 for the supply roll 20 is carried by a lever 98 pivotally mounted on the frame 12. A tension spring 100 is connected between the lever 98 and frame 12 to normally urge the brake 96 against a brake drum 97 on the supply roll 20 to brake it. The tension control 26 also includes an arm 104 pivotally mounted on the frame 12 and carrying the previously mentioned idler 24 at one end. The arm 104 has an extension 106 engagable with the underside of the lever 98. A tension spring 110 is connected between the arm 104 and the frame 12 to urge the arm 104 in the clockwise direction in FIG. 1.

When the sheet material 22 is taut, it pulls the arm 104 in an anticlockwise direction in FIG. 1 against the spring 98 and raises the left hand portion of the lever 98, thereby moving the brake 96 away from the brake drum 97 to permit the supply roll 20 to rotate more freely. When the sheet material 22 is loose, the spring 110 moves the arm extension 170 away from the lever 98, and the spring 100 pivots the lever 98 to urge the brake 97 against the brake drum 97, thereby slowing up the supply roll 20. In this way, the tension controller 26 controls the slackness or tautness of the sheet material 22 between the supply roll 20 and the drive rollers 32, 33.

Figure 3:
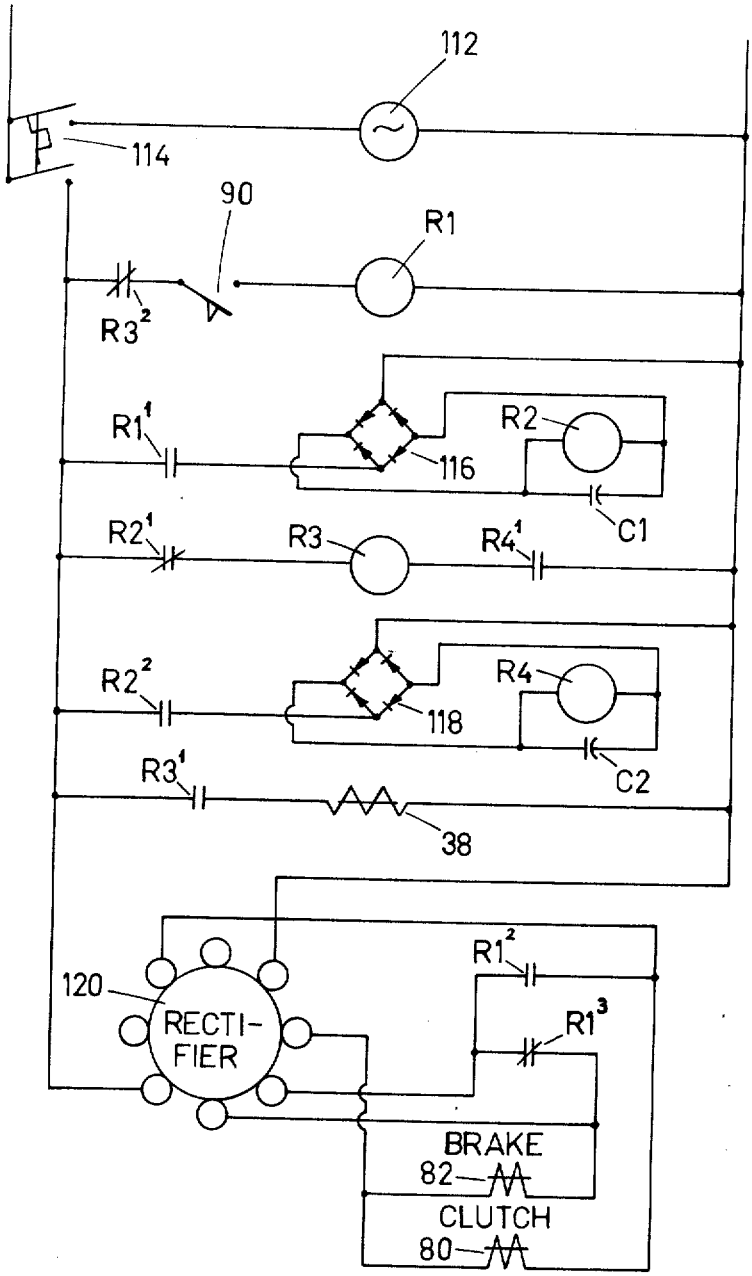
FIG. 3 is an electrical circuit diagram of the control means which controls the feed of sheet material and the cutter.

Referring now to the electrical circuit shown in FIG. 3, several subsidiary circuits are connected across an AC power source 112 and a main switch 114. The first subsidiary circuit includes a first relay $R_1$ in series with microswitch 90 and normally closed contacts $R_3$ controlled by relay $R_3$, which will be described later. The second subsidiary circuit includes normally open contacts $R_1^1$, controlled by relay $R_1$, and an AC bridge rectifier 116. A second relay $R_2$ and a capacitor $C_1$ in parallel therewith are connected across the output of the rectifier 116. The third subsidiary circuit includes a third relay $R_3$ in series with normally closed contacts $R_2^1$ controlled by relay $R_2$ and normally open contacts $R_4^1$ controlled by a relay $R_4$, which will be described later.

The fourth subsidiary circuit includes normally open contacts $R_2^2$ and an AC bridge rectifier 118. The relay $R_4$ and a capacitor $C_2$ in parallel therewith are connected across the output of the rectifier 118. The fifth subsidiary circuit includes normally open contacts $R_3^1$ and knife solenoid 38. The sixth subsidiary circuit effects a supply of power to the clutch 80 through normally open contacts $R_1^2$, also controlled by relay $R_1$, and to the brake 82 through the normally closed contacts $R_1^3$, also controlled by relay $R_1$. Since in this embodiment, the brake 82 and clutch 80 are operated by the direct current, this subsidiary circuit also includes an appropriate rectifier 120.

In operation of the machine, it will be recalled that the first and second conveyors 14, 16 run continuously at the same speed, and the sheet material feed belts 50, 52 also run continuously at a common speed. When an article, such as a pattie or a piece of sliced meat, travels along the first conveyor 14, it will engage and actuate finger 94, thereby closing microswitch 90. Relay $R_1$ is therefore actuated, and its three sets of contacts are operated accordingly. Closure of contacts $R_1^1$ results in actuation of relay $R_2$ and consequent operation of its two sets of contacts. Contacts $R_2^1$ open in the circuit of relay $R_3$. Contacts $R_2^2$ close, and therefore cause actuation of relay $R_4$, with consequent closing of contacts $R_4^1$ in the circuit of Relay $R_3$. At the same time as contacts $R_1^1$ close to cause operation of relays $R_2$ and $R_4$ as just described, contacts $R_1^3$ open to release the brake 82 and contacts $R_1^2$ close to operate clutch 80.

Release of brake 82 and operation of clutch 80 cause the main shaft 68 to drive secondary shaft 76, which in turn drives the sheet material feed rollers 32, 33, it being assumed that sheet material 22 from the supply roll 20 has previously been threaded through the machine to this stage. The drive rollers 32, 33 therefore draw sheet material 22 from the supply roll 20, with the tension controller 26 operating as previously described, and feed the sheet material 22 up through the feed guides 30 and upwardly between the continuously running feed belts 50, 52.

When the article has passed the finger 94, the finger 94 falls back to its original position, thereby opening the microswitch 92. Thus, actuation of relay $R_1$ ceases. Contacts $R_1^2$ open and contacts $R_1^3$ close, ceasing actuation of the clutch 80 and actuating the brake 82, with the result that the feed of sheet material 22 by the feed rollers 32, 33 stops. Contacts $R_1^1$ open to break the circuit to relay $R_2$. However, although the actuation of relay $R_2$ has ceased, it remains in its actuated state for a predetermined time because of the presence of capacitor $C_1$ which controls the loss of voltage across relay $R_2$. During this predetermined time, which may for example be of the order of two-thousandths of a second, the feed rollers 32, 33 come to a complete stop.

At the end of this predetermined period of time, the voltage across relay $R_2$ has fallen sufficiently for it to cause contacts $R_2^1$ to close and contacts $R_2^2$ to open. Opening of contacts $R_2^2$ break the circuit to relay $R_4$, but again this relay $R_4$ remains in its actuated state for a second predetermined period of time due to the presence of capacitor $C_2$. During this second predetermined period of time, both contacts $R_2^1$ and $R_4^1$ are closed, thereby actuating relay $R_3$. Actuation of relay $R_3$ closes contacts $R_3^1$ to cause operation of knife solenoid 38, so that the knife blade 34 is caused to cut the sheet material 22 at the top of the guides 30. Also, contacts $R_3^2$ open to prevent a subsequent article from initiating a new sequence during the time relay $R_3$ is energized. At the end of the second predetermined period of time which may for example be in the order of four-thousandths of a second, the voltage across relay $R_4$ has fallen sufficiently for contacts $R_4^1$ to open, breaking the circuit to relay $R_3$, with consequent opening of contacts $R_3^1$ to break the circuit to knife solenoid 38. Spring 46 then returns knife blade 34 to its original position, and at the same time, contacts $R_3^2$ close, so that the circuit is ready for the next operation.

After knife blade 34 has cut the sheet material 22, the sheet material already fed between continuously running feed belts 50, 52 travels to the upper end of feed belt 52 between pulley 58 and guide 62, where it is engaged by the article which tripped microswitch 90 and initiated the sequence just described, the distance between the microswitch finger 94 and the upper end of feed belt 52 being predetermined accordingly. Sheet material 22 is bent over by the article, so that it travels along the second conveyor 16 with the article on top of it. Minor adjustments in ensuring that the article arrives at the end of the conveyor 14 at the correct time with respect to the feed of the sheet material upwardly between the feed belts 50, 52 can be made by adjusting a position of the microswitch bracket 92 carrying the microswitch 90 and its actuating finger 94. While the sheet material 22 is momentarily stopped between the continuously running feed belts 50, 52, before it is cut from the supply thereof by the knife blade 34, the belts 50, 52 merely slide over the sheet material 22, the friction between the two belts 50, 52 being suitably adjusted so that this occurs. As soon as the cut takes place, the sheet material 22 btetween the feed belts 50, 52 travels upwardly with them.

Thus, the delay between operation of the brake 82 and release of the clutch 80 on the one hand and the operation of knife blade 34 to cut the sheet material on the other hand is primarily determined by the value of capacitor $C_1$. As previously described, the length of this delay is selected so that the time between operating the brake and releasing the clutch on the one hand and operation of the knife blade 34 on the other hand is sufficient to ensure that the feed of sheet material has in fact come to a stop before it is cut. Similarly, the length of time for which the knife solenoid 38 is actuated is primarily determined by the value of capacitor $C_2$.

It will thus be readily understood that the described circuit for controlling operation of the clutch 80, brake 82 and knife 34 enables these elements to be controlled in a particularly advantgeous manner to ensure satisfactory interleaving of sheet material under each article as it passes from conveyor 14 to conveyor 16.

Various modifications within the scope of the invention will be apparent to the man skilled in the art, the scope of the invention being set out in the appended claims.

What I claim is:

1. Apparatus for feeding separate pieces of sheet material from a continuous supply thereof to individual articles travelling along a predetermined path and positioning a piece of sheet material under each article, said apparatus including conveying means for conveying articles sequentially along the predetermined path, means for feeding sheet material from a continuous supply thereof to a cutting station, cutting means at said cutting station operable by an electrical actuating circuit to cut pieces of sheet material from said continuous supply means for feeding said pieces of sheet material from said cutting station to said conveying means for entrainment between the underside of an article and said conveying means at a material positioning station, article sensing means adjacent said predetermined path before said material positioning station operable to sense the presence of an article passing said sensing means, feeding and cutting control means actuated by said article sensing means to cause the feed of sheet material to said cutting station to be commenced when said sensing means senses an article passing thereby and to be stopped when said sensing means senses that the article has passed thereby, said control means including a set electrical time delay device actuated by said article sensing means to set said electrical actuating circuit when an article is sensed by said article sensing means, said article sensing means ceasing actuation of said time delay device when said article has passed by said article sensing means, and said time delay device operating to cause said electrical actuating circuit to operate said cutting means to cut a piece of sheet material from the continuous supply a predetermined time after said sensing means ceases to actuate said control means to stop said feed means, the time delay being predetermined to ensure that feed of sheet material has actually stopped before said cutting means operates.

2. Apparatus according to claim 1 wherein said time delay device includes a relay which controls normally closed contacts in said actuating circuit, said relay being actuated by said sensing means, when sensing an article passing thereby, to open said contacts, said sensing means ceasing to actuate said relay when an article has passed by said sensing means, and said time delay device including means for holding said relay in its actuated state for said predetermined time, after actuation by said sensing means has ceased, after which said relay causes said contacts to close with resultant operation of said cutting means.

3. Apparatus according to claim 2 wherein said means for holding said relay closed is a capacitor connected across said relay.

4. Apparatus according to claim 3 wherein said article sensing means is connected in an AC circuit, and said relay and capacitor are energized from said AC circuit through rectifier means so that said relay and capacitor are supplied with direct current.

5. Apparatus according to claim 1 wherein said control means includes a second electrical time delay device which operates to cause said electrical actuating circuit to cease operation of said cutting means a second predetermined time after said first time delay device has caused said electrical actuating circuit to operate said cutting means.

6. Apparatus according to claim 2 including a second relay which controls normally open contacts in said actuating circuit, said second relay being actuated by said first relay, when said first relay is in its actuated state, to close said contacts, said second time delay device including means for holding said second relay in its actuated state, after actuation by said first relay has ceased for a second predetermined time after which said second relay causes said contacts to open with resultant cessation of actuation of said cutting means.

7. Apparatus according to claim 6 wherein said means for holding said second relays closed includes a capacitor connected across each relay.

8. Apparatus according to claim 7 wherein said control sensing means is connected in an AC circuit, and said relays and capacitors are energized from said AC circuit through rectifier means so that said relays and capacitors are supplied with direct current.

* * * * *